United States Patent [19]

Sano et al.

[11] Patent Number: 4,499,167

[45] Date of Patent: Feb. 12, 1985

[54] PHOTOCONDUCTIVE COMPOSITIONS COMPRISING AN ORGANIC PHOTOCONDUCTOR AND AN AMIDE COMPOUND AND ELECTRO-PHOTOGRAPHIC LIGHT-SENSITIVE MATERIALS USING THE COMPOSITIONS

[75] Inventors: Kenji Sano; Syunichi Kondo; Hideo Sato, all of Saitama, Japan

[73] Assignee: Fuji Photo Film Co., Ltd., Kanagawa, Japan

[21] Appl. No.: 449,729

[22] Filed: Dec. 14, 1982

[30] Foreign Application Priority Data

Dec. 14, 1981 [JP] Japan ..... 56-201306

[51] Int. Cl.[3] ..... G03G 5/09

[52] U.S. Cl. ..... 430/83; 430/70; 430/75

[58] Field of Search ..... 430/63, 77, 83

[56] References Cited

U.S. PATENT DOCUMENTS 4,377,629 3/1983 Tarumi et al. ..... 430/63

4,399,206 8/1983 Katagiri et al. ..... 430/77

*Primary Examiner*—John E. Kittle

*Assistant Examiner*—John L. Goodrow

*Attorney, Agent, or Firm*—Sughrue, Mion, Zinn, Macpeak & Seas

[57] ABSTRACT

Photoconductive compositions composed of an organic photoconductor or a dye-sensitized organic photoconductor are disclosed. The composition have their sensitivity increased by the addition of an amide compound to the photoconductive composition. The photoconductive compositions are used in constructing electrophotographic light-sensitive materials having sufficiently high sensitivity for practical use. Various specific amide compounds which have been found to be effective are disclosed.

8 Claims, No Drawings

PHOTOCONDUCTIVE COMPOSITIONS COMPRISING AN ORGANIC PHOTOCONDUCTOR AND AN AMIDE COMPOUND AND ELECTRO-PHOTOGRAPHIC LIGHT-SENSITIVE MATERIALS USING THE COMPOSITIONS

FIELD OF THE INVENTION

This invention relates to a photoconductive composition using an organic photoconductor as the main component and an electrophotographic light-sensitive material using the foregoing the photoconductive composition as the electrophotographic light-sensitive layer. More particularly, the invention relates to a high-sensitive photoconductive composition containing an organic photoconductor and an amide compound as the main components and also to a high-sensitive electrophotographic light-sensitive material using the photoconductive composition as the electrophotographic light-sensitive layer.

BACKGROUND OF THE INVENTION

Known photoconductive materials for electro-photographic light-sensitive compositions include various organic compounds some of which are known to compounds have considerably high sensitivity. However, it is very rare at persent to practically use organic photoconductive materials for electrophotographic materials.

Organic photoconductive materials for photoconductors have various excellent properties as compared with inorganic photoconductive materials or photoconductors and hence provide a wide range of technical application in the technical field of electrophotography. For example, the production of transparent electrophotographic light-sensitive films, flexible electrophotographic light-sensitive films, light-weight and easily handling electro-photographic light-sensitive films, etc., have become possible for the first time using organic photoconductors. Also, organic photoconductors have such properties as a film-forming property during the production of electro-photographic light-sensitive materials, a surface smoothness, and a selectivity of a charging polarity for electro-photographic processes. Inorganic photoconductors do not have such properties.

In spite of having various excellent properties, the organic photoconductors have not sufficiently contributed to the technical field of electrophotography up to now mainly because of their low light-sensitivity and the brittleness of the films or layers of the photoconductors.

The study of organic photoconductors was first made on compounds such as low molecular heterocyclic compounds, nitrogen-containing aromatic compounds, and various high molecular aromatic compounds. As the results of such studies, some compounds having a considerably high sensitivity were found. However, recently a sensitization for obtaining higher sensitivity is likely to become the center of study. This is because even organic photo-semiconductive compounds do not have sufficient sensitivity such that they can be used without the need of the application of a sensitizing treatment. Therefore, when practically using an organic photoconductor, it is necessary to select the most effective sensitizing method and apply the sensitization to organic photoconductors. Therefore, it is clear that the industrial value of an organic photoconductor depends upon the extent of the sensitivity of the electrophotographic light-sensitive material finally obtained by a sensitizing means applied.

The most generally known method such as a sensitizing method is the addition of a sensitizing dye and the addition of a Lewis acid, which can be applied to almost all organic photoconductors. The former method sensitizes the organic photoconductor by imparting the spectral absorption characteristics of a dye to the organic photoconductor and the latter method sensitizes the organic photoconductor by forming a complex of donor and acceptor in the organic photoconductor to provide a new spectral sensitivity.

SUMMARY OF THE INVENTION

As the result of the inventors' investigations on the method of further sensitizing an organic photoconductor which has been dye-sensitized, it has been discovered that the light-sensitivity of the organic photoconductor is greatly increased by the addition of an amide compound shown by general formula I to III described later.

A primary object of this invention is to provide an excellent sensitizing method for organic photoconductors and thereby provide a photoconductive composition having a sensitivity which is sufficiently high for the composition to be used for electrophotographic light-sensitive materials.

Another object of this invention is to provide a transparent or light-weight, easy to handle, electrophotographic light-sensitive film which can be sufficiently used for industrial practice and also has high sensitivity and excellent mechanical strength.

It has now been found that the foregoing objects of this invention can be achieved by the compositons shown below:

That is, the invention is;

(1) a photoconductive composition comprising (a) an organic photoconductor and (c) an amide compound;

(2) the photoconductive composition of (1) wherein the composition further contains (b) a sensitizing dye capable of increasing the light sensitivity of foregoing organic photoconductor;

(3) the photoconductor composition of (1) or (2) wherein the foregoing amide compound is a compound represented by following general formula I to III

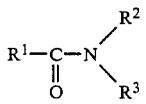

I

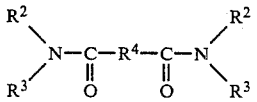

II

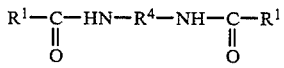

III wherein, $R^1$ represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring; said two $R^1$s in general formula III may be the same or different;

$R^2$ and $R^3$, which may be the same or different, each represents a hydrogen atom, an alkyl group, a substituted alkyl group, a substituted or unsubstituted monocyclic or bicyclic condensed aryl group, or a monovalent group induced from a substituted or unsubstituted heterocyclic ring; and $R^4$ represents a methylene group, a polymethylene group, a branched alkanediyl group, or an arylene group;

said $R^1$ and $R^2$ or said $R^2$ and $R^3$ in general formula I, $R^2$ and $R^3$, or, $R^2$ or $R^3$ and $R^4$ in general formula II and $R^1$ and $R^4$ in general formula III may combine with each other;

(4) an electrophotographic light-sensitive material comprising a support at least the surface of which has an electric conductivity having formed thereon a layer of a photoconductive composition containing (a) an organic photoconductor and (c) an amide compound;

(5) the electrophotographic light-sensitive material of (4) wherein said layer of the photoconductive composition further contains (b) a sensitizing dye capable of increasing the light sensitivity of the foregoing organic photoconductor; and (6) the electrophotographic light-sensitive material of (4) or (5) wherein the foregoing amide compound is a compound represented by following general formula I to III;

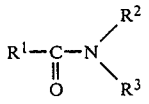

I

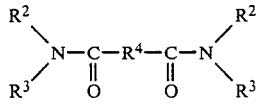

II

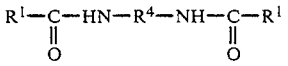

III wherein, $R^1$ represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring; said two $R^1$s in general formula III may be the same or different;

$R^2$ and $R^3$, which may be the same or different, each represents a hydrogen atom, an alkyl group, a substituted alkyl group, a substituted or unsubstituted monocyclic or bicyclic condensed aryl group, or a monovalent group induced from a substituted or unsubstituted heterocyclic ring; and $R^4$ represents a methylene group, a polymethylene group, a branched alkanediyl group, or an arylene group;

aid $R^1$ and $R^2$ or said $R^2$ and $R^3$ in general formula I, $R^2$ and $R^3$, or, $R^2$ or $R^3$ and $R^4$ in general formula II and $R^1$ and $R^4$ in general formula III may combine with each other.

DESCRIPTION OF THE PREFERRED EMBODIMENT

The organic photoconductor (a) used in this invention is explained below. Any organic photoconductors which can be dye-sensitized can be used in this invention and preferred examples are as follows:

(i) High molecular organic photoconductors:

High molecular organic photoconductors containing polycyclic aromatic rings or heterocyclic aromatic rings composed of vinyl polymers containing a $\pi$-electron system in the main chan or the side chain thereof.

The typical $\pi$-electron systems contained in the high molecular organic photoconductors include polycyclic aromatic hydrocarbons such as naphthalene, anthracene, pyrene, perylene, acenaphthalene, phenylanthracene, diphenylanthracene, etc.; heterocyclic aromatic ring compounds such as carbazole, indole, acridine, 2-phenylindole; N-phenylcarbazole, etc.; and the halogen derivatives and lower alkyl derivatives of them. The polymers containing these $\pi$-electron systems are used as the photoconductive polymers in this invention.

Examples of such polymers include vinyl polymers such as polyvinylnaphthalene, polyvinylanthracene, polyvinylpyrene, polyvinylperylene, polyacenaphthalene, polystyrylanthracene, polyvinylcarbazole, polyvinylindole and polyvinylacridine, vinyl copolymers containing the above vinyl compound, such as vinyl naphthalene, vinyl acenaphthylene, vinyl anthracene, vinyl carbazole, etc., vinyl ether polymers such as polyanthrylmethyl vinyl ether, polypyrenylmethyl vinyl ether, polycarbazolylethyl vinyl ether and polyindolylethyl vinyl ether; epoxy resins such as polyglycidylcarbazole, polyglycidylindole and poly-p-glycidylanthrylbenzene; polymers such as polyacrylic acid ester and polymethacrylic acid ester containing the foregoing $\pi$-electron system as a substituent and the copolymers thereof; and the condensed polymers of the foregoing $\pi$-electron system compounds and formaldehyde. The molecular weight of the polymers containing the $\pi$-electron systems ranges 100 to 1,000,000, preferably 1,000 to 100,000.

Preferred examples of the foregoing polymers are poly-N-vinylcarbazole; poly-N-vinylcarbazole having a substituent such as aryl group, alkylaryl group, amino group, alkylamino group, dialkylamino group, arylamino group, diarylamino group, N-alkyl-N-arylamino group, nitro group, halogen atom, etc., at the carbazole ring (hereinafter, is referred to as poly-N-vinyl substituted carbazoles); and N-vinylcarbazole copolymers.

Examples of N-vinylcarbazole copolymers include those which containing more than 50 mole% of the following N-ethylcarbazole constitutional repeating unit;

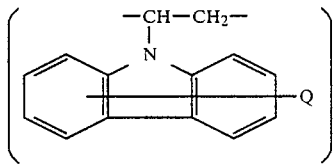

wherein Q represents a substituent same as the aforesaid substituent for the poly-N-vinyl substituted carbazoles.

Examples of the residual constructional repeating unit of the N-vinylcarbazole copolymer include 1-phenylethylene, 1-cyanoethylene, 1-cyano-1-methylethylene, 1-chloroethylene, 1-(alkoxycarbonyl)-ethylene and 1-alkoxycarbonyl-1-methylethylene, (each is the structural repeating unit originated in styrene, acrylonitrile, methacrylonitrile, vinyl chloride, alkyl acrylate, or alkyl methacrylate; the alkyl group of the alkoxycarbonyl group is an alkyl group having 1–18 carbon atoms, such as, practically, a methyl group, an ethyl group, a hexyl group, a dodecyl group, an octadecyl group, and a 4-methylcyclohexyl group). The constitutional repeating unit is defined in "Kobunshi (High Molecules)", Vol. 27, 345–359 (1978) and "Pure and Applied Chemistry", Vol. 48, 373–385 (1976), Japanese translation.

(ii) Aromatic tertiary amino compounds:

Triphenylamine, N,N-di-benzylaniline, diphenylbenzylamine, N,N-di(p-chlorobenzyl)aniline, di(β-naphthyl)benzylamine, tri(p-tolyl)amine, and diphenylcyclohexylamine.

(iii) Aromatic tertiary diamino compounds:

N,N,N′,N′-tetrabenzyl-p-phenylenediamine, N,N,N′,N′-tetra(p-chlorobenzyl)-p-phenylenediamine, N,N,N′,N′-tetramethyl-p-phenylenediamine N,N,N′,N′-tetrabenzyl-m-phenylenediamine, N,N,N′,N′-tetramethylbenzidine, N,N,N′,N′-tetrabenzylbenzidine, N,N,N′,N′-tetraphenyl-p-phenylenediamine, N,N,N′N′-tetraphenyl-m-phenylenediamine, 1,1-bis[4-(benzylamino)phenyl]ethane, 1,1-bis[4-(dibenzylamino)phenyl]propane, 1,1-bis[4-(dibenzylamino)-phenyl]butane, 1,1-bis[4-(dibenzylamino)phenyl]-2-methylpropane, 2,2-bis[4(dibenzylamino)phenyl]propane, 2,2-bis[4-(dibenzylamino)phenyl]butane, 1,1-bis[4-[di(m-methylbenzyl)amino]phenyl]-propane, 1,1-bis[p-(dimethylamino)phenyl]-1-phenylmethane, 1,1-bis[p-(diethylamino)phenyl]-1-phenylmethane, bis[4-(dibenzylamino)phenyl]methane, bis[4-[di(p-chlorobenzyl)-amino]phenyl]methane, 1,1-bis[p-(dimethylamino)-phenyl]-1-phenylethane, 4,4′-benzylidene-bis(N,N-dimethyl-m-toluidine), 4′,4″-bis(diethylamino)-2,6-dichloro-2′,2″-dimethyltriphenyl-methane, 1,1-bis 4-(diethylamino)-2-methylphenyl-1-α-naphthylmethane, 4′,4″-bis(dimethylamino)-2-chloro-2′,2″-dimethyltriphenylmethane, 1,1-bis[p-(diethylamino)phenyl]-1-phenylethane, 1,1-diphenyl-5,5-bis[4-(diethylamino)-2-methylphenyl]-1,3-pentadiene, 1,1-diphenyl-3,3-bis[4-(diethylamino)-2-methylphenyl]-1-propane, bis[4-(dibenzylamino)phenyl]ether, bis[4-(diethylamino]phenyl ether, bis[4-(dibenzylamino)phenyl]sulfide, 2,2-bis[4-(di-p-tolylamino)-phenyl]propane, 1,1-bis[4-(di-p-tolylamino)phenyl]-1-phenylethane, and 1,1-bis[4-dibenzylamino)phenyl]-1,1-diphenylmethane.

(iv) Aromatic tertiary triamino compounds:

Tris[4-(diethylamino)phenyl]methane and 1,1-bis[4-(diethylamino)-2-methylphenyl]-1-[4-(dimethylamino)-phenyl]methane.

(v) Condensation products:

A condensation product of an aldehyde and an aromatic amine, a condensation product of a tertiary aromatic amine and an aromatic halogen compound, poly-p-phenylene-1,3,4-oxadiazole, and a condensation product of formaldehyde and a condensed polycyclic aromatic compound.

(vi) Metal-containing compounds:

2-Mercaptobenzothiazole lead salt, 2-mercaptobenzothiazole zinc salt, 2-mercaptobenzothiazole copper salt, 2-mercaptobenzoxazole lead salt, 2-mercapto-5-phenylbenzoxazole lead salt, 2-mercapto-6-methoxybenzimidazole lead salt, 8-hydroxyquinoline magnesium salt, 8-hydroxyquinoline aluminum salt, 8-hydroxyquinoline lead salt, 7-benzyl-8-hydroxyquinoline copper salt, and 2-hydroxy-4-methylazobenzene copper salt.

(vii) Heterocyclic derivatives:

(a) Pyrazoline derivatives:

1,3,5-Triphenylpyrazoline, 1-phenyl-3-[p-(dimethylamino)styryl]-5-[p-(dimethylamino)phenyl]-pyrazoline, 1,5-diphenyl-3-styrylpyrazoline, 1,3-diphenyl-5-styryl-pyrazoline, 1,3-diphenyl-5-[p-(dimethylamino)phenyl]pyrazoline, and 1,3-diphenyl-5-(2-furyl)pyrazoline.

(b) 1,2,4-Triazine derivatives:

3-[p-(Dimethylamino)phenyl]-5,6-di(p-dimethylphenyl)-1,2,4-triazine, 3-[p-(dimethylamino)-phenyl]-5,6-di(2-pyridyl)-1,2,4-triazine, 3-[p-(dimethylamino)-phenyl]-5,6-di(p-ethoxyphenyl)-1,2,4-triazine, 3-[p-(diethylamino)phenyl]-5,6-di(p-methoxyphenyl)-1,2,4-triazine, and 3-[p-(diethylamino)phenyl]-5,6-di(p-ethoxyphenyl)-1,2,4-triazine.

(c) Quinazoline derivatives:

2,4-Diphenylquinazoline, 2-phenyl-4-p-tolylquinazoline, 2-phenyl-4-[4-(dimethylamino)phenyl]-quinazoline, 2-phenyl-4-styrylquinazoline, and 2,4-diphenylbenzo[h]quinazoline.

(d) Benzofuran derivatives:

6-Hydroxy-2-phenyl-3-[4-(dimethylamino)-phenyl]-benzofuran, 6-hydroxy-2,3-di(4-methoxyphenyl)-benzofuran, and 2,3,5,6-tetra(4-methoxyphenyl)-benzo[1,2-b-5,4-b′]difuran.

(e) Oxadiazole derivatives:

2,5-Bis[4-(dimethylamino)phenyl]-1,3,4-oxadiazole, 2,5-bis[4-(diethylamino)phenyl]-1,3,4-oxadiazole, 2,5-bis-[4-(isoamylamino)phenyl]-1,3,4-oxadiazole, 2,5-bis[4-(cyclopentylamino)phenyl]-1,3,4-oxadiazole, and 2,5-bis[4-(ethylamino)phenyl]-1,3,4-oxadiazole.

Of the above organic photoconductive materials, materials (i), (ii), (iii), (viia), (viib), and (viid) are preferably used.

The sensitizing dyes (b) used for increasing the light sensitivity of the organic photoconductors in this invention are well-known sensitizing dyes used for the technique of the dye sensitization of organic photoconductors. These sensitizing dyes are typically the various sensitizing dyes disclosed in "Society of Photographic Scientists and Engineer", 19,60–64 (1975); "Applied Optics", Suppl., 3, 50 (1969); U.S. Pat. Nos. 3,037,861; 3,250,615; 3,712,811; British Pat. No. 1,353,264; "Research Disclosure"; No. 10,938 (109, 1973, May, page 62 and below); U.S. Pat. Nos. 3,141,700 and 3,938,994 (incorporated herein by reference to disclose such sensitizing dyes) and Japanese Patent Application (OPI) Nos. 14,560/'81; 29,586/'81; 29,587/'81; 65,885/'81; 14,561/'81; 114,259/'80; and 35,141/'81. (The term "OPI" as used herein refers to a "published unexamined Japanese Patent Application.) The sensitizing dyes used in this invention may be properly selected from these known sensitizing dyes and other dyes capable of increasing the light-sensitivity of the high molecular organic photoconductors.

The sensitizing dye is used in an amount by which the organic photoconductor of the component (a) is sensitized and the amount depends upon the natures of the organic photoconductor used and the sensitizing dye but is generally from about 0.001% to about 100%, preferably from about 0.01% to about 30% by weight based on the amount of the high molecular weight organic photoconductor.

The amide compounds shown by general formulae I to III, which are the characteristic component (c) in this invention, can be prepared by the methods described in "Beilsteins Handbuch der organischen Chemie"; Vol. 12, page 262 (incorporated herein by reference to disclose such methods). In addition, these amide compounds are effective not only for organic photoconductors but also for inorganic photoconductors which can be dye-sensitized, such as ZnO, etc.

When one of $R^1$ to $R^3$ in general formulae I to III is an alkyl group if may be a straight chain or branched alkyl group having 1–22 carbon atoms. In the case that $R^1$ is the alkyl group, it is preferred that $R^2$ or $R^3$ is a hydrogen atom or a straight chain or branched alkyl group of 1–5 carbon atoms, and in the case that $R^2$ is the alkyl group, it is preferred that $R^3$ is a hydrogen atom or a straight chain or branched alkyl group of 1–5 carbon atoms.

When one of $R^1$ to $R^3$ in general formulae I to III is a substituted alkyl group, it may be a straight chain or branched alkyl group having 1 to 22 carbon atoms and may be substituted with 1 to 3 halogen atoms (chlorine atom, bromine atom, fluorine atom, etc.), cyano groups, nitro groups or phenyl groups, or tolyl groups bonded thereto as the substituent. A hydrogen atom or a straight chain or branched alkyl group having 1 to 5 carbon atoms is preferred for $R^2$ or $R^3$ in the case that $R^1$ is the substituted alkyl group, or for $R^3$ in the case that $R^2$ is the substituted alkyl group.

When $R^1$ is an alkoxy group or a substituted alkoxy group, it may include the alkoxy group or the substituted alkoxy groups corresponding to the foregoing alkyl group or substituted alkyl group. In this case, it is also preferred that another one of $R^2$ and $R^3$ be a hydrogen atom.

When one of $R^1$ to $R^3$ is a monocyclic or bicyclic condensed aryl group, examples of the aryl group are a phenyl group or a naphthyl group.

When one of $R^1$ to $R^3$ is a substituted monocyclic or substituted bicyclic condensed aryl group it may be a phenyl group or a naphthyl group having 1 to 3 substituents and the substituent may be a halogen atom (chlorine atom, bromine atom, fluorine atom, etc.), a cyano group, a nitro group, a straight chain or branched alkyl group of 1–5 carbon atoms, a straight chain or branched alkoxy group of 1–5 carbon atoms, an alkoxy carbonyl group having a straight chain or branched alkyl group of 1–5 carbon atoms, or an acyl group having a straight chain or branched alkyl group of 1–5 carbon atoms, A hydrogen atom is preferred for $R^2$ or $R^3$, in the case that $R^1$ is the substituted or unsubstituted monocyclic or bicyclic condensed aryl group, or for $R^3$ in the case that $R^2$ is the substituted or unsubstituted monocyclic or bicyclic condensed aryl group.

When $R^1$ is a substituted or unsubstituted monocyclic or bicyclic condensed aryloxy group it may include aryloxy groups corresponding to the foregoing substituted or unsubstituted monocyclic or bicyclic condensed aryl group. When this take place $R^2$ or $R^3$ is preferably a hydrogen atom.

One of $R^1$ to $R^3$ may be a monovalent group induced from a monocyclic or bicyclic condensed heterocyclic ring. Examples of the monovalent groups include a pyrrolidinyl group, a piperidinyl group, a piperidino group, a morpholinyl group, a morpholino group, a pyrrolyl group, an imidazolyl group, a pyridyl group, a pyrimidinyl group, an indolinyl group, an isoindolinyl group, an indolyl group, an isoindolyl group, a benzimidazolyl group, a quinolyl group, and an isoquinolyl group.

One of $R^1$ to $R^3$ may be a monovalent group induced from a monocyclic or bicyclic condensed heterocyclic ring having 1 to 3 substituents. Examples of the substituents include a halogen atom (chlorine atom, bromine atom, fluorine atom, etc.), a cyano group, a nitro group, a phenyl group, a tolyl group, a benzyl group, a phenethyl group, and a straight chain or branched alkyl groups of 1–5 carbon atoms. A hydrogen atom is preferred for $R^2$ or $R^3$ in the case that $R^1$ is the substituted or unsubstituted monovalent group induced from the monocyclic or bicyclic condensed heterocyclic ring, or for $R^3$ in the case that $R^2$ is the substituted or unsubstituted monovalent group induced from the monocyclic or bicyclic condensed heterocyclic ring.

$R^1$ and $R^2$ or $R^3$ and $R^4$ in general formula I, $R^2$ and $R^3$, or $R^2$ or $R^3$ and $R^4$ in general formula II, and $R^1$ and $R^4$ in general formula III may combine with each other and form a trimethylene group, a tetramethylene group, a pentamethylene group, an oxydiethylene group ($—CH_2—CH_2—O—CH_2—CH_2—$), and these divalent groups may have 1–3 hydrogen atoms of which are substituted by a halogen atom (chlorine atom, bromine atom, fluorine atom, etc.), a cyano group, a nitro group, a phenyl group, a tolyl group, a benzyl group, a phenethyl group, or a straight chain or branched alkyl group of 1–5 carbon atoms.

When one of $R^1$ to $R^3$ is a monovalent group induced from an alkyl group, alkoxy group, aryl group, aryloxy group, or heterocyclic ring each having 2 or 3 substituents, any substituents may be employed.

When $R^4$ is a polymethylene group it may contain 2–22 carbon atoms. When $R^4$ is a branched alkanediyl group it may contain 3–22 carbon atoms having one monovalent free valence at each of the two optional carbon atoms thereof. When $R^4$ is an arylene group it may be a o-, m-, or p-phenylene group or a naphthylene group having one monovalent free valence at each of the optional two carbon atoms thereof.

The amide compounds represented by general formulae IV to XI described later have remarkable effects in that they increase the light sensitivity, they have good compatibility with organic photoconductors. In particular, they are compatible with poly-N-vinylcarbazole, poly-N-vinyl substituted carbazoles, N-vinylcarbazole copolymers and N-vinyl substituted carbazole copolymers. Furthermore, these amide compounds impart good film properties such as good uniformity, high strength, good flexibility, and strong adhesive strength with respect to supports, of an electrophotographic light-sensitive layer. Among these compounds, it has been found that the compounds shown by general formulae VI, IX, and X act as a film property improving agent for poly-N-vinylcarbazole, poly-N-vinyl substituted carbazoles, and the copolymers of N-vinylcarbazole or N-vinyl substituted carbazoles. Also, it has been confirmed that these amide compounds are also effective for dye-sensitized zinc oxide photoconductors.

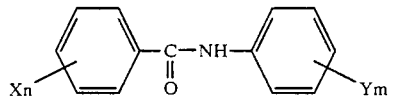

(IV)

-continued (V)

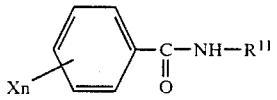

(VI)

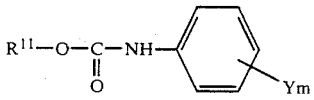

(VII)

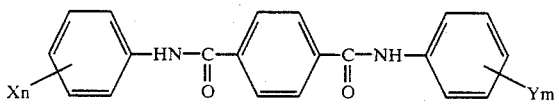

(VIII)

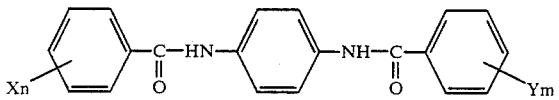

(IX)

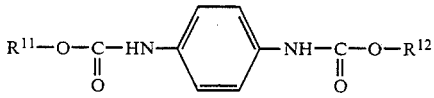

(X)

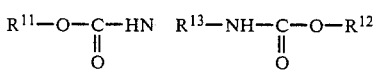

(XI)

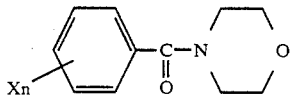

In the general formulae IV to XI, m and n each represents 1, 2, or 3;

X and Y each represents a hydrogen atom, a straight chain or branched alkyl group of 1–15 carbon atoms, a straight chain or branched alkyl group of 1–15 carbon atoms having a substituent, an alkoxy group of 1–10 carbon atoms, a halogen atom, a nitro group, or a cyano group; when m or n is 2 or 3, said Xs or said Ys, or said X and Y may be the same or different;

$R^{11}$ and $R^{12}$ each represents a straight chain or branched alkyl group of 1–15 carbon atoms, a straight chain or branched alkyl group of 1–15 carbon atoms having a substituent, a phenyl group, or a substituted phenyl group; and $R^{13}$ represents a polymethylene group of 1–15 carbon atoms or a branched alkanediyl group.

Practical examples of the compounds shown by general formula IV are benzanilide, 4-chlorobenzanilide, 4-cyanobenzanilide, 3-chlorobenzanilide, 4-nitrobenzanilide, 3-nitrobenzanilide, 4-ethoxycarbonylbenzanilide, 4'-methoxybenzanilide, 4'-chlorobenzanilide, 3'-chlorobenzanilide, 4'-cyanobenzanilide, 4'-nitrobenzanilide, 3'-nitrobenzanilide, 4'-ethyloxycarbonylbenzanilide, 4'-acetylbenzanilide, 4,4'-dichlorobenzanilide, 4,3'-dichlorobenzanilide, 4-chloro-4'-nitrobenzanilide, 4-chloro-4'-benzylanilide, 3,3'-dichlorobenzanilide, 3,3'-dinitrobenzanilide, 3-nitro-4-acetylbenzanilide, 3-nitro-3'-chlorobenzanilide, 4-methoxy-4'-nitrobenzanilide, 4,4'-diethyloxycarbonylbenzanilide, 4,4'-dibutyloxycarbonylbenzanilide, etc.

Practical examples of the compounds shown by general formula V are N-ethylbenzenecarboamide, N-butylbenzenecarboamide, N-propylbenzenecarboamide, etc.

Practical examples of the compounds shown by general formula VI are methyl N-phenylcarbamate, ethyl N-phenylcarbamate, ethyl N-(p-chlorophenyl)carbamate, ethyl N-(p-nitrophenyl)carbamate, ethyl N-(m-nitrophenyl)carbamate, butyl N-(p-nitrophenyl)carbamate, butyl N-(m-nitrophenyl)-carbamate, ethyl N-(p-ethyloxycarbonylphenyl)carbamate, butyl N-(p-butyloxycarbonylphenyl)carbamate, etc.

Practical examples of the compounds shown by general formula VII are 1,4-bisanilinocarbonylbenzene, 1,4-bis(p-chloroanilinocarbonyl)benzene, 1,4-bis(p-nitroanilinocarbonyl)benzene, 1,4-bis(p-butyloxycarbonylanilino)benzene, etc.

Practical examples of the compounds shown by general formula VIII are N,N'-diacyl-1,4-phenylenediamine, N,N'-di(p-chloroacyl)-1,4-phenylenediamine, N,N'-di(m-nitroacyl)-1,4-phenylenediamine, N-m-chloroacyl-N'-p-ethyloxycarbonylacyl-1,4-phenylenediamine, etc.

Practical examples of the compounds shown by general formula IX are 1,4-bis(ethoxycarbonylamino)benzene, 1,4-bis(butoxycarbonylamino)benzene, etc.

Practical examples of the compounds shown by general formula X are 1,4-bis(ethoxycarbonylamino)butane, 1,3-bis(butoxycarbonylamino)propane, etc.

Practical examples of the compounds shown by general formula XI are p-nitrophenylmorpholinylketone, etc.

The photoconductive compositions of this invention may further contain, if necessary, known structure agents, plasticizers, dyes, pigments, etc., in addition to the foregoing three components in an amount that the photo-conductive composition is unharmed.

Examples of useful structure agents include cyanoethyl cellulose, nitrile rubber, a polycarbonate of bisphenol A, a linear polyester, a styrene-butadiene copolymer and a vinylidenechloride-acrylonitrile copolymer. Examples of useful plasticizers include biphenyl chloride, an epoxy resin, a triphenylmethane compound, a cumarone resin and a low molecular weight xylene resin.

The photoconductive composition of this invention can be prepared by dispersing or dissolving the foregoing three components together with, if necessary, other components as described above in a common solvent to form a dispersion or a homogeneous solution. Also, the electrophotographic lightsensitive material of this invention can be prepared by coating the foregoing dispersion or solution on a proper support and then removing (or evaporating) the solvent. As the case may be, the photoconductive composition may be used as the dispersion or the solution thereof without completely removing the solvent. That is, the electrophotographic light-sensitive material of this invention may be prepared by coating the dispersion or solution of the photoconductive composition on a suitable support having a conductive surface and drying to form a conductive layer thereon. According to the use, an adhesive layer, etc., may be formed on the photoconductive layer.

Examples of common solvents include benzene, toluene, xylene, chlorobenzene, dichloromethane, dichloroethane, trichloroethane, cyclohexanone, tetrahydrofuran, dioxane and mixtures of them. These solvents may be selected from solvents which can dissolve or disperse the high molecular organic photoconductor, the sensitizing dye or dyes, and the compound shown by general formula I to III together with, if necessary, other additional components.

The content of the compound shown by general formula I to III in this invention is determined by the relation with the amount of the organic photoconductor contributing to the photoconductive insulating property of the photoconductive composition. Practically, the proportion of the compound shown by general formula I to III is 1-100 parts by weight, preferably 3-30 parts by weight per 100 parts by weight of the organic photoconductor. When the compound is added over the foregoing proportion, it creates bad influences such as reducing the light sensitivity of the photoconductive composition and increasing the residual potential thereof.

Examples of useful supports having a conductive surface include drums or sheets of a metal such as aluminum, copper, iron, zinc, etc., and papers, plastic sheets or glass plates subjected to a surface conductive treatment by a vapor deposition of a metal such as aluminum, copper, zinc, indium, etc., a vapor deposition of a conductive metal compound such as $In_2O_3$, $SnO_2$, etc., or coating of a dispersion of a powder of a conductive metal compound such as $In_2O_3$, $SnO_2$, etc., or a metal powder in a binder.

The photoconductive composition of this invention can be dispersed in an insulating solvent as the fine particles thereof and images can be formed by the electrophoretic photographic process described in U.S. Pat. Nos. 3,384,565; 3,384,488; 3,510,419 (incorporated herein by reference to disclose such processes); etc., using the aforesaid dispersion.

The invention will now be described more practically based on the following examples. However, the invention is not limited in the scope to these examples.

EXAMPLE 1

In 20 ml of 1,2-dichloroethane was dissolved 1 g of poly-N-vinylcarbazole (PvCz) and then 25 mg of 2,6-di-t-butyl-4-[4-(N-methyl-N-2-cyanoethylamino)styryl]-thiapyrylium tetrafluoroborate was added to the solution.

The foregoing mixture was coated on a polyethylene terephthalate (PET) film 100 μm thick having a vapor-deposited layer of $In_2O_3$ having a thickness of 60 n.m. (hereinafter, is referred to as $In_2O_3$-conductive PET film) and dried to remove the solvent and to form a photoconductive layer (electrophotoconductive layer) 5 μm thick. Thus, electrophotographic film No. 1 (comparison sample) was prepared.

A solution containing the amide compound shown in Table 1 was prepared by adding the compound to a part of the foregoing mixture in the amount in the same table per 100 parts by weight of PvCz and the solution was coated on an $In_2O_3$-conductive PET film as described above. The coating was dried to remove the solvent and to form a photoconductive layer 5 μm thick. Thus, electrophotographic films No. 2 to No. 51 were prepared.

The sensitivity of the photoconductive layer of each of the electrophotographic films No. 1 to No. 51 thus prepared was measured and the exposure amount ($E_{50}$) that the initial potential (500 volts) became ½ thereof by light decay and the exposure amount ($E_{90}$) that the initial potential became 1/10 thereof are shown in Table 1. Monochromatic light of 630 n.m. was used as the light source.

EXAMPLE 2

By following the same procedures as when preparing samples No. 1, No. 2, and No. 3 in Example 1 except that 25 mg of 2,6-di-t-butyl-4-[4-(N,N-dichloroethylaminostyryl]-thiapyrylium tetrafluoroborate or 25 mg of Rhodamin B (C.I. #45170) was used in place of 25 mg of 2,6-di-t-butyl-4-[4-(N-methyl-N-2-cyanomethylamino)styryl]thiapyrylium tetrafluoroborate in Example 1, electrophotographic films No. 52 (comparison sample), No. 53 and No. 54, and electrophotographic films No. 55 (comparison sample), No. 56 and No. 57 were prepared. The sensitivity of each photoconductive layer was measured according to the same manner as in Example 1. The results are shown in Table 2.

EXAMPLE 3

By following the same procedures as when preparing samples No. 1, No. 2, and No. 3 in Example 1 except that a PET film having a layer of $SnO_2$ fine powder/-gelatin was used in place of the $In_2O_3$-conductive PET film in Example 1, electrophotographic films No. 58 (comparison sample), No. 59, and No. 60 were prepared. The sensitivity was measured according the method as in Example 1. The results are shown in Table 2.

EXAMPLE 4

In 5 ml of methylene chloride was dissolved the composition described in Table 3 and the solution was coated on a conductive layer ($In_2O_3$ vapor-deposited layer) at a dry thickness of 7 μm. Thus, electrophotographic films No. 61, No. 62, No. 63, and No. 64 were prepared and the results of measuring the sensitivities according to the same manner as in Example 1 are shown in Table 3.

The PET film having a conductive layer containing $SnO_2$ fine powder dispersed in gelatin was prepared as follows.

(1) A mixture of 65 parts by weight of stannic chloride hydrate and 1.5 parts by weight of antimony trichloride was dissolved in 1,000 parts by weight of ethanol to prepare a uniform solution. To the uniform solution thus obtained was dropwise added a 1N aqueous sodium hydroxide solution until the pH of the solution reached 3 to thereby obtain co-precipitated colloidal stannic oxide and antimony oxide. The thus-obtained co-precipitated product was allowed to stand at 50° C. for 24 hours to obtain a red-brown colloidal precipitate.

The red-brown colloidal precipitate thus obtained was separated with a centrifugal separator. In order to remove excessive ions, water was added to the precipitate and the resulting mixture was subjected to centrifugal separation to wash the precipitate. This procedure was repeated three times to remove excessive ions.

The thus-obtained excessive ion-free colloidal precipitate (100 parts by weight) was mixed with 50 parts by weight of barium sulfate having an average grain size of 0.3μ and 1,000 parts by weight of water. The resulting mixture was sprayed in a burning furnace maintained at 900° C. to obtain a bluish powdery mixture comprising stannic oxide and barium sulfate and having an average grain size of 0.1μ.

The thus-obtained mixture (1 g) was placed in an insulative cylinder having an inner diameter of 1.6 cm. The specific resistance of the powder was measured with stainless steel electrodes while sandwiching the powder with the stainless steel electrodes at a pressure of 1,000 Kg/cm$^2$, and it was found to be 11 Ω-cm.

| | | |
|---|---|---|
| (2) | $SnO_2$ Powder obtained in the above step (1) | 10 parts by weight |
| | Water | 150 parts by weight |
| | 30% Aqueous Solution of Ammonia | 1 part by weight |

A mixture comprising the foregoing ingredients was dispersed for 1 hour with a paint shaker to obtain a uniform dispersion. This uniform dispersion was subjected to centrifugal separation at 2,000 rpm for 30 minutes to remove large particles. Th supernatant liquid thus obtained was subjected to centrifugal separation at 3,000 rpm for 1 hour to obtain a $SnO_2$ paste comprising fine particles.

The thus-obtained $Sn_2O$ paste (10 parts by weight) was mixed with 25 parts by weight of a 10% aqueous solution of gelatin and 100 parts by weight of water, and the resulting mixture was dispersed for 1 hour with a paint shaker to obtain an electrically-conductive coating solution.

The electrically-conductive coating solution was coated on a 100 μm polyethylene terephthalate (PET) film in a dry coating amount of 2 g/m$^2$ to obtain an electrically-conductive support.

TABLE 1

| Electro-photographic Film No. (Comparison) | Amide Compound | Addition Amount (parts by weight) | $E_{50}$ erg/cm$^2$ | $E_{90}$ erg/cm$^2$ |
|---|---|---|---|---|
| 1 | — | — | 65 | 430 |
| 2 | 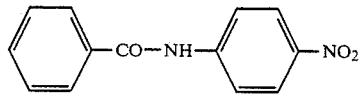 | 5 | 36 | 207 |
| 3 | | 10 | 34 | 199 |
| 4 | 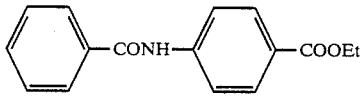 | 5 | 45 | 275 |
| 5 | | 10 | 41 | 247 |
| 6 | 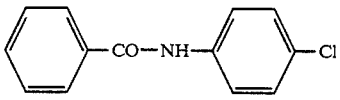 | 5 | 38 | 221 |
| 7 | | 10 | 37 | 205 |
| 8 | 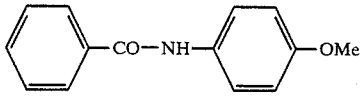 | 5 | 45 | 280 |
| 9 | | 10 | 43 | 263 |
| 10 | 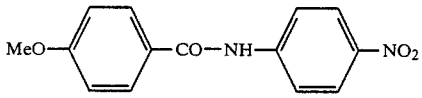 | 2 | 40 | 231 |
| 11 | | 5 | 37 | 212 |
| 12 | 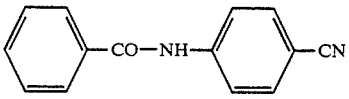 | 2 | 40 | 231 |
| 13 | | 5 | 36 | 207 |
| 14 | 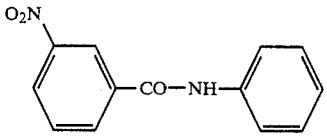 | 5 | 48 | 288 |
| 15 | | 10 | 41 | 241 |
| 16 | 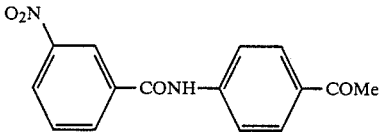 | 5 | 40 | 234 |
| 17 | | 10 | 38 | 212 |
| 18 | 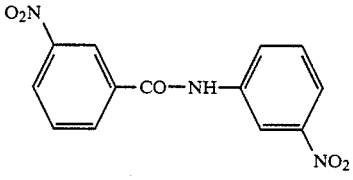 | 2 | 36 | 205 |
| 19 | | 5 | 28 | 164 |

TABLE 1-continued
| Electro-photographic Film No. (Comparison) | Amide Compound | Addition Amount (parts by weight) | $E_{50}$ erg/cm$^2$ | $E_{90}$ erg/cm$^2$ |
|---|---|---|---|---|
| 20 | 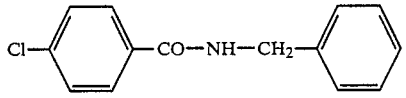 | 5 | 41 | 250 |
| 21 | | 10 | 38 | 232 |
| 22 | 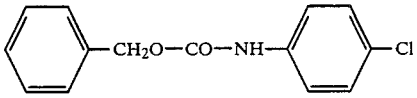 | 5 | 54 | 360 |
| 23 | | 10 | 53 | 331 |
| 24 | 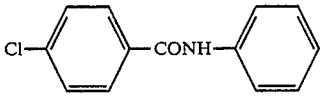 | 5 | 64 | 400 |
| 25 | | 10 | 41 | 217 |
| 26 | 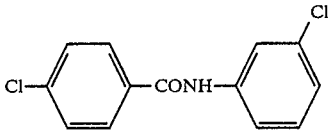 | 5 | 44 | 267 |
| 27 | | 10 | 36 | 207 |
| 28 | 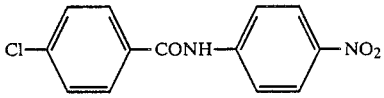 | 2 | 56 | 280 |
| 29 | | 5 | 54 | 240 |
| 30 | 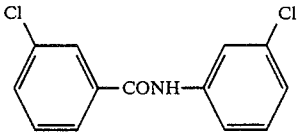 | 2 | 41 | 238 |
| 31 | | 5 | 38 | 230 |
| 32 | 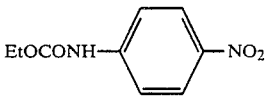 | 5 | 41 | 232 |
| 33 | | 10 | 36 | 196 |
| 34 | 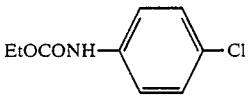 | 5 | 49 | 284 |
| 35 | | 10 | 45 | 257 |
| 36 | 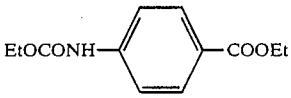 | 5 | 56 | 331 |
| 37 | | 10 | 54 | 311 |
| 38 | 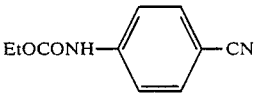 | 5 | 43 | 248 |
| 39 | | 10 | 41 | 234 |
| 40 | 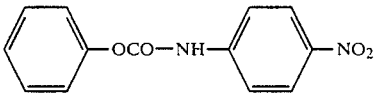 | 5 | 38 | 236 |
| 41 | | 10 | 36 | 218 |
| 42 | 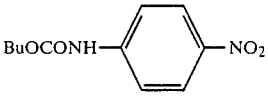 | 5 | 44 | 260 |
| 43 | | 10 | 40 | 230 |

TABLE 1-continued

| Electro-photographic Film No. (Comparison) | Amide Compound | Addition Amount (parts by weight) | $E_{50}$ erg/cm$^2$ | $E_{90}$ erg/cm$^2$ |
|---|---|---|---|---|
| 44 | 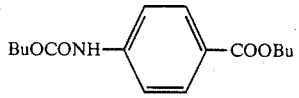 | 5 | 53 | 336 |
| 45 | | 10 | 52 | 326 |
| 46 | 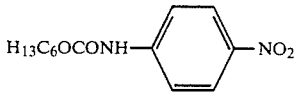 | 5 | 45 | 271 |
| 47 | | 10 | 41 | 231 |
| 48 | 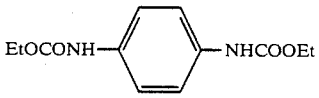 | 5 | 50 | 330 |
| 49 | | 10 | 48 | 321 |
| 50 | 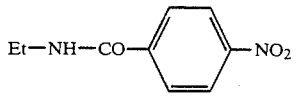 | 5 | 42 | 240 |
| 51 | | 10 | 40 | 231 |

TABLE 2

| No. | Dye | Amide Compound | Addition Amount | $E_{50}$ | $E_{90}$ |
|---|---|---|---|---|---|
| (Comparison) 52 | 2,6-di-t-butyl-4-[4-(N,N—dichloroethyl-amino)-styryl]thiapyryliumtetrafluoroborate | — | — | 60 | 412 |
| 53 | | 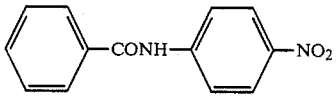 | 5 | 34 | 198 |
| 54 | | Same as No. 53 | 10 | 32 | 185 |
| (Comparison) 55 | Rhodamine B | — | — | 140 | 1020 |
| 56 | | 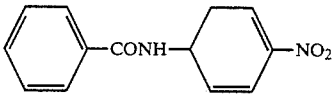 | 5 | 84 | 670 |
| 57 | | Same as No. 56 | 10 | 69 | 506 |
| (Comparison) 58 | Same as No. 1 | — | — | 66 | 441 |
| 59 | | 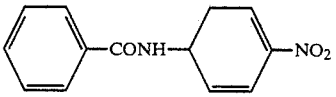 | 5 | 37 | 210 |
| 60 | | Same as No. 59 | 10 | 35 | 201 |

TABLE 3

| No. | Composition | | $E_{50}$ (erg · sec) | $E_{90}$ (Lux · sec) | Vo-60/Vo (%) |
|---|---|---|---|---|---|
| 61 | Polycarbonate of bisphenol A (Lexane) | 0.8 g | 495 | 6200 | 99 |
| | 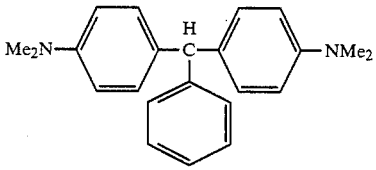 | 0.4 g | | | |

TABLE 3-continued

| No. | Composition | | $E_{50}$ (erg · sec) | $E_{90}$ (Lux · sec) | Vo-60/Vo (%) |
|---|---|---|---|---|---|
| | 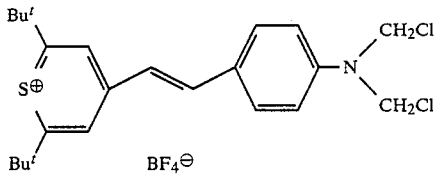 | 2.0 mg | | | |
| 62 | Composition No. 61 + 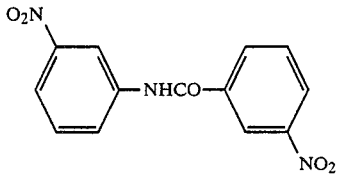 | 0.02 g | 140 | 930 | 98 |
| 63 | Polycarbonate of bisphenol A (Lexane) | 0.8 g | 338 | 4300 | 92 |
| | 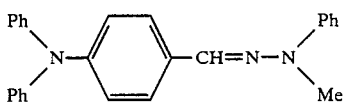 | 0.4 g | | | |
| | 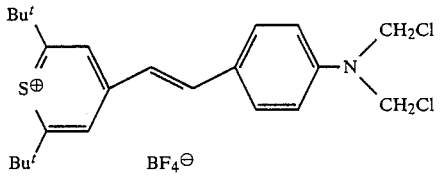 | 2.0 mg | | | |
| 64 | Composition No. 63 + 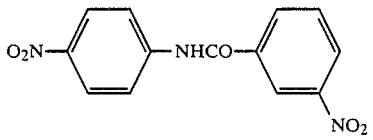 | 0.02 g | 158 | 1030 | 95 |

It can be seen from the above results in Table 1 to 3 that the electrophotographic films of the invention, having an electrophotographic light-sensitive layer containing amide compounds are of higher sensitivity than the electrophotographic films, having an electrophotographic light-sensitive layer containing none of amide.

While the invention has been described in detail and with reference to specific embodiments thereof, it will be apparent to one skilled in the art that various changes and modifications can be made therein without departing from the spirit and scope thereof.

What is claimed is:

1. A photoconductive composition, comprising a mixture of: an organic photoconductor and an amide compound, wherein said amide compound is a compound selected from the group consisting of general formula I, II, and III;

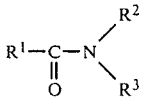 I

-continued

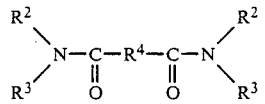 II

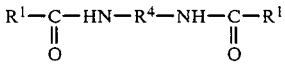 III wherein, $R^1$ represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring; said two $R^1$s in general formula III may be the same or different;

$R^2$ and $R^3$, which may be the same or different, each represents a hydrogen atom, an alkyl group, a substituted alkyl group, a substituted or unsubstituted monocyclic or bicyclic condensed aryl group, or a monovalent group induced from a substituted or unsubstituted heterocyclic ring; and $R^4$ represents a methylene group, a polymethylene group, a branched alkanediyl group, or an arylene group;

said $R^1$ and $R^2$ or said $R^2$ and $R^3$ in general formula I, $R^2$ and $R^3$, or, $R^2$ or $R^3$ and $R^4$ in general formula II and $R^1$ and $R^4$ in general formula III may combine with each other.

2. The photoconductive composition as claimed in claim 1, further comprising a sensitizing dye capable of increasing the light sensitivity of the said organic photoconductor.

3. An electrophotographic light-sensitive material comprising a support having an electrically conductive surface having formed thereon a layer of a photoconductive composition comprising an organic photoconductor and an amide compound, wherein said amide compound is a compound selected from the group consisting of general formula I, II, and III;

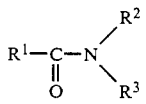

I

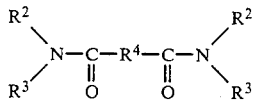

II

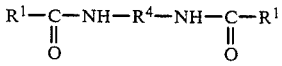

III wherein, $R^1$ represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring; said two $R^1$s in general formula III may be the same or different;

$R^2$ and $R^3$, which may be the same or different, each represents a hydrogen atom, an alkyl group, a substituted alkyl group, a substituted or unsubstituted monocyclic or bicyclic condensed aryl group, or a monovalent group induced from a substituted or unsubstituted heterocyclic ring; and $R^4$ represents a methylene group, a polymethylene group, a branched alkanediyl group, or an arylene group;

said $R^1$ and $R^2$ or said $R^2$ and $R^3$ in general formula I, $R^2$ and $R^3$, or, $R^2$ or $R^3$ and $R^4$ in general formula II and $R^1$ and $R^4$ in general formula III may combine with each other.

4. The electrophotographic light-sensitive material as claimed in claim 3 wherein the layer of the photoconductive composition is further comprised of a sensitizing dye capable of increasing the light sensitivity of the organic photoconductor.

5. The photoconductive composition as claimed in claim 2, wherein the sensitizing dye is present in an amount of about 0.01% above 100% by weight based on the weight of the organic photoconductor.

6. The photoconductive composition as claimed in claim 5, wherein the sensitizing dye is present in an amount of about 0.01% to about 30% by weight based on the weight of the organic photoconductor.

7. The photoconductive composition as claimed in claim 1, wherein the amide compound is present in an amount of 1 to 100 parts by weight per 100 parts by weight of the organic photoconductor.

8. The photoconductive composition as claimed in claim 7, wherein the amide compound is present in an amount of about 3 to 30 parts by weight per 100 parts by weight of the organic photoconductor.

* * * * *